US007540780B2

(12) United States Patent
Akino

(10) Patent No.: US 7,540,780 B2
(45) Date of Patent: Jun. 2, 2009

(54) MICROPHONE CONNECTOR

(75) Inventor: Hiroshi Akino, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 870 days.

(21) Appl. No.: 11/195,829

(22) Filed: Aug. 3, 2005

(65) Prior Publication Data

US 2006/0045303 A1 Mar. 2, 2006

(30) Foreign Application Priority Data

Aug. 30, 2004 (JP) ..... 2004-250234

(51) Int. Cl.
*H01R 13/66* (2006.01)

(52) U.S. Cl. ..... 439/620.14; 439/620.22

(58) Field of Classification Search ..... 439/620.1, 439/620.13, 620.09, 620.14, 620.22, 620.24, 439/620.25, 76.1
See application file for complete search history.

(56) References Cited

U.S. PATENT DOCUMENTS

| | | | | |
|---|---|---|---|---|
| 3,944,756 | A * | 3/1976 | Lininger | 381/355 |
| 5,704,810 | A * | 1/1998 | Shimasaki | 439/620.1 |
| 5,803,769 | A * | 9/1998 | Belopolsky | 439/620.1 |
| 5,830,016 | A * | 11/1998 | Chuang | 439/620.09 |
| 6,364,712 | B2 * | 4/2002 | Durr et al. | 439/620.09 |
| 6,506,079 | B1 * | 1/2003 | Dingenotto et al. | 439/620.1 |
| 6,776,661 | B2 * | 8/2004 | Dingenotto et al. | 439/620.09 |
| 6,837,747 | B1 * | 1/2005 | Kosmala | 439/620.09 |
| 7,063,546 | B2 * | 6/2006 | Akino | 439/620.21 |
| 7,390,221 | B2 * | 6/2008 | Akino | 439/609 |
| 2003/0171034 | A1 * | 9/2003 | Edwards et al. | 439/620 |
| 2005/0148227 | A1 * | 7/2005 | Akino | 439/218 |
| 2005/0239305 | A1 * | 10/2005 | Akino | 439/106 |
| 2006/0046538 | A1 * | 3/2006 | Akino | 439/101 |
| 2006/0046570 | A1 * | 3/2006 | Akino | 439/610 |
| 2006/0046571 | A1 * | 3/2006 | Kosmala | 439/620 |
| 2007/0134985 | A1 * | 6/2007 | Frysz et al. | 439/620.09 |
| 2007/0238358 | A1 * | 10/2007 | Akino | 439/610 |
| 2008/0038946 | A1 * | 2/2008 | Akino | 439/95 |
| 2008/0207057 | A1 * | 8/2008 | Akino | 439/610 |

FOREIGN PATENT DOCUMENTS

| | | |
|---|---|---|
| JP | 11-155198 | 6/1999 |
| JP | 11-341583 | 12/1999 |
| JP | 2002-152892 | 5/2002 |

* cited by examiner

*Primary Examiner*—Ross N Gushi
(74) *Attorney, Agent, or Firm*—Oblon, Spivak, McClelland, Maier & Neustadt, P.C.

(57) ABSTRACT

A microphone connector comprising a receptacle which is made of a conductive material, receives a cable connector at one end of a microphone cable, includes a bottom plate, and a plurality of pins passing through the bottom plate. In the microphone connector, a cylindrical metal tube is coupled to a periphery of the bottom plate and is electrically integral with the receptacle; a printed circuit board is attached to the cylindrical metal tube and covers an opening thereof; connecting terminals are electrically integral with the pins, extend outward from the bottom plate, pass through the printed circuit board, and are electrically connected to wiring patterns on the printed circuit board; and capacitors are connected between the wiring pattern for the grounding pin and the wiring patterns for the other pins, and short-circuit high frequency signals.

5 Claims, 6 Drawing Sheets

MICROPHONE CONNECTOR

CROSS REFERENCE TO RELATED APPLICATIONS

This invention is based upon and claims the benefit of priority from prior Japanese Patent Application No. 2004-250234 filed on Aug. 30, 2004; the entire contents of which are incorporated by reference herein.

BACKGROUND OF THE INVENTION

1. Field of the Invention

This invention relates to a structure of a connector used for a microphone, and more particularly to a structure of a connector connecting a dedicated cord and a microphone unit or a power module in a capacitor microphone.

2. Description of the Related Art

Usually, a capacitor microphone has a high impedance in a microphone unit, and includes an impedance converter constituted by a field effect transistor (FET).

With a tiepin or gooseneck type microphone, a microphone unit itself houses an impedance converter therein in order to make the microphone less visible. Further, a low-cut circuit and an output circuit are housed in separate circuit housings, and a dedicated microphone cable is used to connect the microphone unit and the circuit housing. The microphone unit converts voices into electric audio signals, which are transmitted to the circuit housing, and are output from the output circuit. Such a circuit housing is called a "power module".

The dedicated microphone cable connecting the microphone unit and the power module is a 2-conductor shielded cable, and is constituted by a power wire supplying power to the microphone, a signal wire inputting the audio signals to the power module, and a shielded cable which electrostatically shield the power wire and signal wire.

The audio signal is transmitted in an unbalanced state through the microphone cable, and suffers from poor immunity to external noise, i.e., is adversely affected by external electromagnetic waves. Specifically, external electromagnetic waves arriving at the microphone cable enter into the microphone unit or power module, are detected by a semiconductor device composing the microphone unit or power module, and are mixed into the audio signals as noise.

A microphone output is output from the power module via a balanced shielded cable. When strong electromagnetic waves are applied to the microphone or the output cable of the microphone, a high frequency current runs through a microphone connector and gets into the microphone, where the high frequency current is demodulated by a semiconductor device, and is output as audio frequency noise via the microphone.

A cable connector 10 shown in FIG. 6(A) of the accompanying drawings is connected to one end of a dedicated microphone cable. The cable connector 10 is fitted into a receptacle 30 shown in FIG. 5(A). Specifically, the cable connector 10 includes three thin cylinders 11 embedded therein, which receive three pins of the receptacle 30. Terminal blocks 12 integral with the thin cylinders 11 extend outward from a rear surface of the cable connector 10 (the right end in FIG. 6(A)). Two conductors and a shielded wire of the microphone cable, not shown, are soldered to their corresponding terminal blocks 12. An insulating sleeve 60 is attached around the microphone cable, surrounds a joint of the terminal blocks 12 and the microphone cable, and protects the joint against short-circuiting. The insulating sleeve 60 is as thick as the connector 10.

A cylindrical part 71 of a crimp 70 is fitted into a rear end of the insulating sleeve 60. The crimp 70 has a plurality of claws 72 at its rear half. The claws 72 are pressed onto an insulating sheath of the microphone cable, so that the crimp 70 is integral with the microphone cable.

The cable connector 10 is fitted into a cylindrical connector housing 50. The connector housing 50 is long enough to hold the cable connector 10, the insulating sleeve 60 and the cylindrical part 71 of the crimp 70. A rear end of the connector housing 50 is fitted into a front end of the bush 40, which is slightly thicker than the microphone cable, and has a tapered end 141 and a cover 142 which is thicker than the tapered end 141. The microphone cable is put through a center opening of the tapered end 141.

The cable connector 10 and the receptacle 30 (shown in FIG. 5) are of so-called 3-pin type. No. 1 pin is used for the shielded wire of the microphone cable, is electrically connected to the connector housing 50, crimp 70 and bush 40, and is grounded. A signal conductor and a power conductor of the microphone cable are respectively connected to No. 2 and No. 3 pins.

FIG. 5(A), FIG. 5(B) and FIG. 5(C) show the structure of the receptacle 30. The receptacle 30 is a metal cylinder, and has a male screw 31 on a peripheral surface thereof, and a flange 33 at one end thereof (shown at the right side in FIG. 5(A)). The receptacle 30 is put into the power module or the like through an opening thereof. A nut is engaged into the male screw 31 via an inner wall of a power module housing. Hence, the receptacle 30 is fixed to the power module housing with the nut and flange 33 holding opposite surfaces of the power module housing. The receptacle 30 has a bottom which is opposite to the flange 33. A relatively large and thick bottom plate 32 made of an insulating material is fixed to, screwed to or fitted to the bottom of the receptacle 30. Three pins 41 pass through the bottom plate 32. One end of a plug shown in FIG. 6 is inserted into the receptacle 30. Specifically, referring to FIG. 6, a left part of the connector housing 50 is inserted into the receptacle 30. The three pins 41 are fitted into the three thin cylinders 11 of the cable connector 10, respectively. The three pins 41 are used for grounding, transmitting and receiving signals, and supplying power. The three pins 41 partially extend outward from the bottom plate 32, and function as connector terminals 42, which are connected to the power module and so on using wires.

As described above, the receptacle 30 attached to the power module or microphone unit has to be grounded by connecting No. 1 grounding pin to the power module or microphone unit housing. Usually, the connecting terminal 42 of No. 1 pin is connected using an electric wire to a grounding point of the power module or the microphone unit. However, this arrangement tends to introduce high frequency currents into the power module or microphone unit. High frequency currents are demodulated by an impedance converter, and are outputted as audible frequency noise via the microphone.

For the purpose of short-circuiting high frequency currents between No. 1 and No. 2 pins and between No. 1 and No. 3 pins, ceramics capacitors (i.e., chip devices) are soldered across No. 1 and No. 2 pins and across No. 1 and No. 3 pins. However, in such a case, the pins tend to be minutely displaced each time the plug is attached into or detached from the receptacle 30. There is a problem that the ceramics capacitors are subject to stresses via soldered parts thereof, and will be broken.

In order to overcome the foregoing problem, it is conceivable to mount ceramics capacitors on a printed circuit board, to connect them between No. 1 and No. 2 pins and between No. 1 and No. 3 pins using printed wirings. The printed wiring pattern used for the grounding should be reliably connected to the receptacle 30 in order to cope with high frequency signals. However, with the foregoing arrangement of the related art, a number of improvements have to be made in order to block high frequency signals.

At present, as cellular phones become very popular, high frequency electromagnetic waves are present anywhere, and more high frequency signals tend to enter into audio signals. Especially, a capacitor microphone is easily susceptible to noise caused by high frequency signals from cellular phones arriving via the connector.

Up to now, proposals have been made in order to cover microphone bodies using cylindrical sheaths as disclosed in Japanese Patent Laid-Open Publications No. 2002-152,892 and Hei 11-155,198. No special emphasis has been placed on shielding of connectors as described above. Therefore, high frequency electromagnetic waves tend to enter into the connector, which causes noise to be mixed into audio signals.

The assignor of this application has proposed a structure which couples a microphone housing to a grounding terminal of a connector with a minimum impedance in the patent application (Japanese Patent Laid-Open Publication No. Hei 11-341,583, for example). Especially, the structure has been designed to effectively ground the connector. However, it does not have a concept of installing capacitors between pins in order to block external high frequency signals.

In order to overcome problems of the related art, the present invention is aimed at providing a microphone connector, in which capacitors made of chip devices are disposed between pins in order to block external high frequency signals, and are not broken even if the pins are displaced when attaching and detaching a plug to and from a receptacle.

Further, the invention provides a microphone connector which reliably blocks external high frequency signals.

SUMMARY OF THE INVENTION

According to the invention, there is provided a microphone connector comprising a receptacle which is made of a conductive material, receives a cable connector at one end of a microphone cable, includes a bottom plate, and a plurality of pins pass through the bottom plate. In the microphone connector, a cylindrical metal tube is coupled to a periphery of the bottom plate and is electrically integral with the receptacle; a printed circuit board is attached to the cylindrical metal tube and covers an opening of the cylindrical metal tube; connecting terminals are electrically integral with the pins, extend outward from the bottom plate, pass through the printed circuit board, and are electrically connected to wiring patterns on the printed circuit board; and capacitors are connected between the wiring pattern for the grounding pin and the wiring patterns for the other pins, and short-circuit high frequency signals.

DETAILED DESCRIPTION OF THE INVENTION

Figure 5:
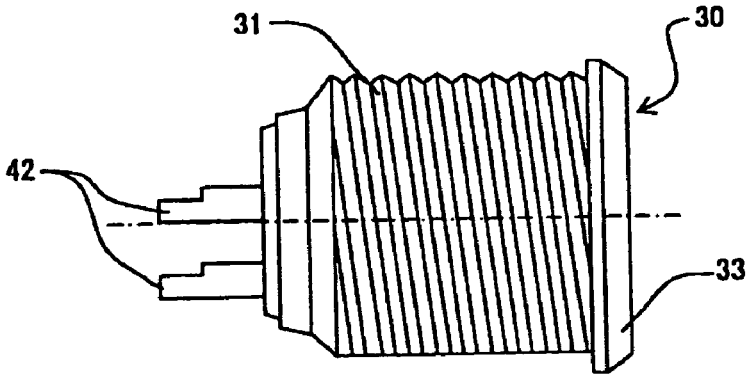
FIG. 5(A) is a side elevation of a microphone connector of the related art.
FIG. 5(B) is a bottom plan view of the microphone connector of FIG. 5(A)
FIG. 5(C) is a side elevation of the capacitor.
Figure 5:
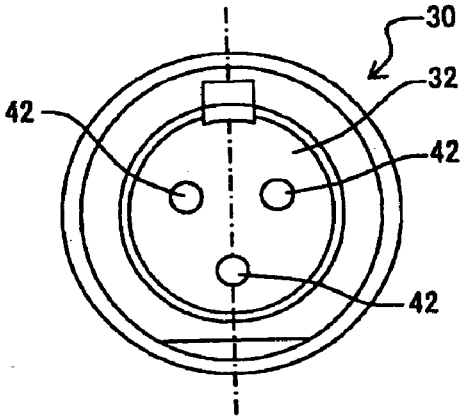
Figure 5:
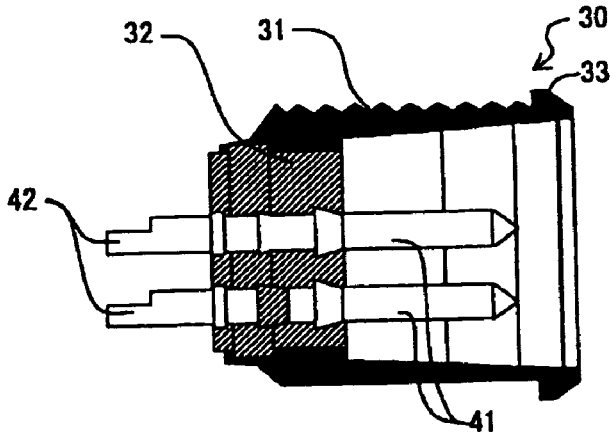
Figure 6:
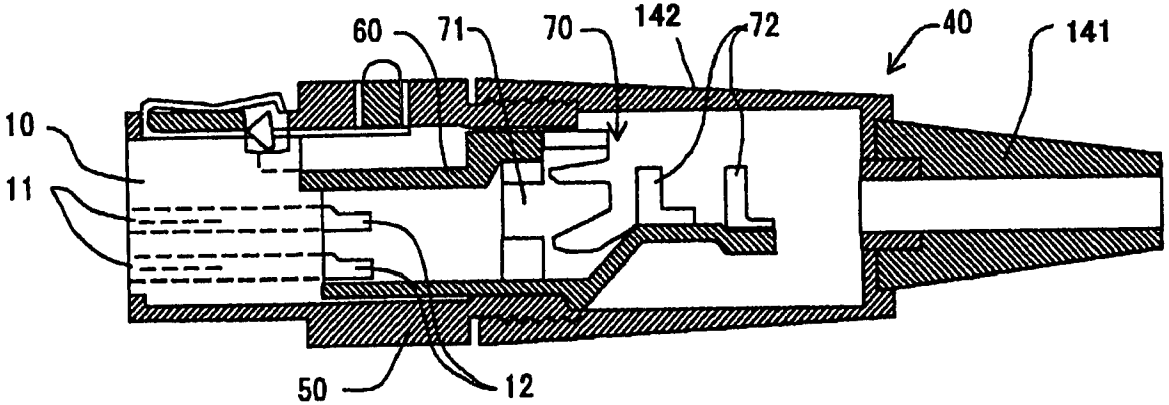
FIG. 6(A) is a side elevation of a plug attached to and detached from a microphone connector.
FIG. 6(B) is a front elevation of the plug.
Figure 6:
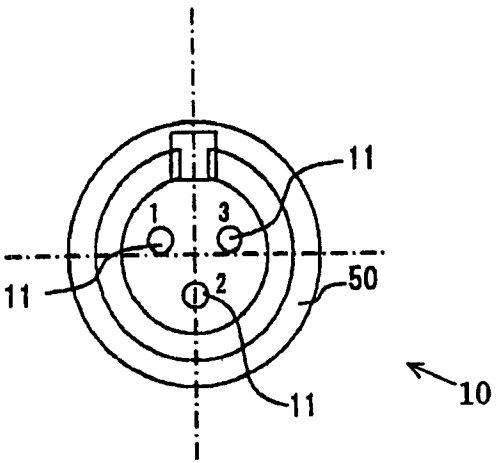

The invention will be described hereinafter with reference to a microphone connector shown in the drawings except for FIG. 4 and FIG. 6. The same and similar reference numbers are assigned to the same and similar parts shown in FIG. 4 and FIG. 5.

Figure 1:
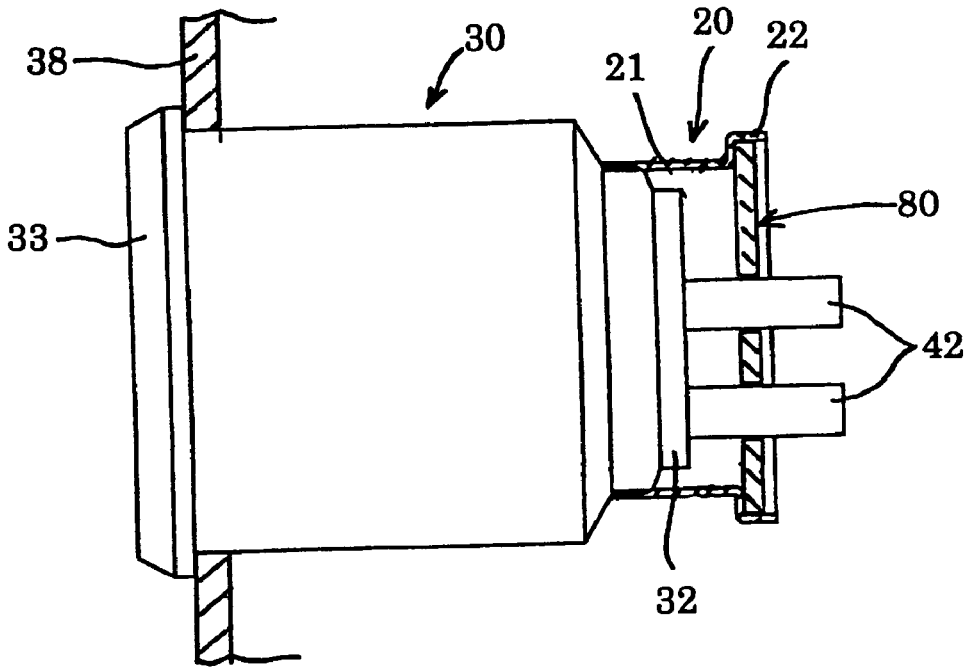
FIG. 1 is a side elevation and partly sectional view of a microphone connector in an embodiment of the invention.

Referring to FIG. 1, a receptacle 30 is a metal cylinder, and includes a flange 33 extending on its one peripheral end. The receptacle 30 is fitted into a power module housing 38 via an opening thereof A nut is screwed into the receptacle 30 via an inner surface of the power module housing 38. Hence, the receptacle 30 is fixedly attached in the power module housing 38 using the flange 33 and the nut. Further, a relatively thick bottom plate 32 is fitted to or screwed to the receptacle 30 at its end opposite to the flange 33. The bottom plate 32 is made of an insulating material, and has three pins embedded therethrough. Three connecting terminals 42 which are electrically integral with the three pins extend outward from the bottom plate 32.

One end of a plug (shown in FIG. 6) is fitted into the receptacle 30. Specifically, a part of a connector housing 50, shown at the left side of FIG. 6, is inserted into the receptacle 30 via a left opening (shown in FIG. 1). The three pins of the receptacle 30 are fitted into three receiving parts 11 of the cable connector 10. The three pins are used for grounding, receiving and transmitting signals, and supplying power. The three connecting terminals 42 are integral with the three pins, and are connected to specified parts of the power module and so on using electric wires.

Figure 2:
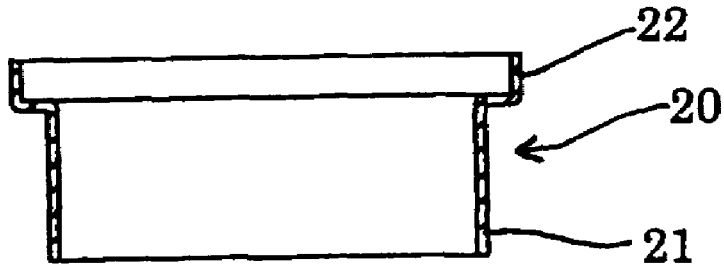
FIG. 2(A) is a cross section of a metal cylindrical tube of the microphone connector.
FIG. 2(B) is a bottom plan view of the metal cylindrical tube.
Figure 2:
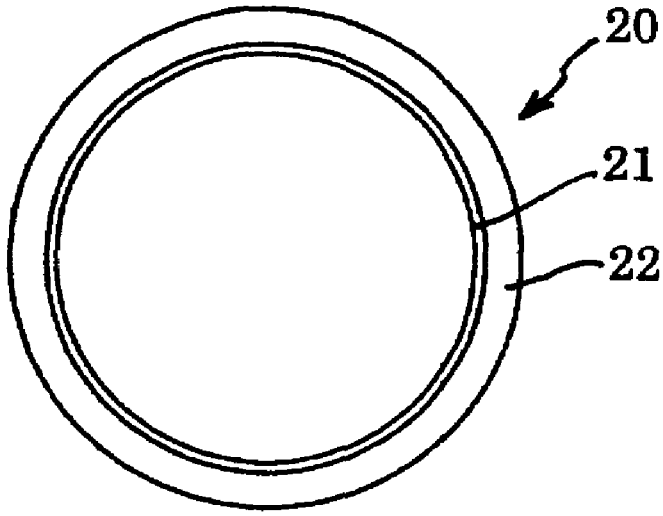

A cylindrical metal tube 20 is coupled around the bottom (at the right end in FIG. 1) of the receptacle 30, and is electrically integral with the receptacle 30. As shown in FIG. 2(A), the cylindrical metal tube 20 has a main part 21 and a flange 22 at its one end. The flange 22 is thicker than the main part 21. The main part 21 is fitted around a cylindrical part at the bottom of the receptacle 30. Hence, the cylindrical metal tube 20 is electrically integral with the receptacle 30. A printed circuit board 80 is attached on the flange 22 of the cylindrical metal tube 20, thereby closing an opening of the cylindrical metal tube 20. The three connecting terminals 42 pass through openings of the printed circuit board 80.

Figure 3:
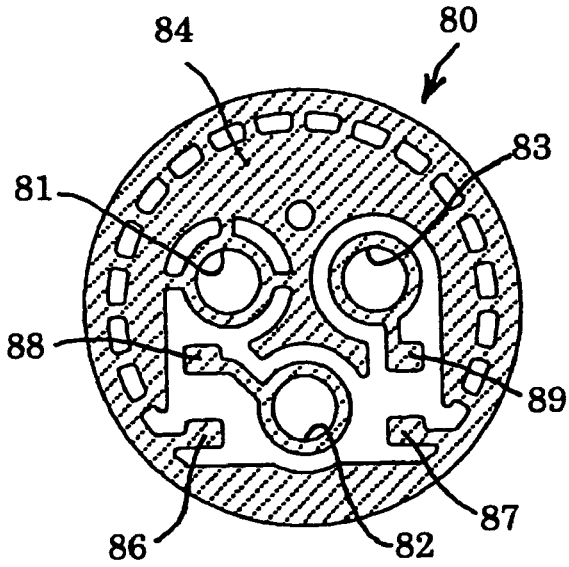
FIG. 3(A) is a rear elevation of a printed circuit board.
FIG. 3(B) is a front elevation of the printed circuit board.
Figure 3:
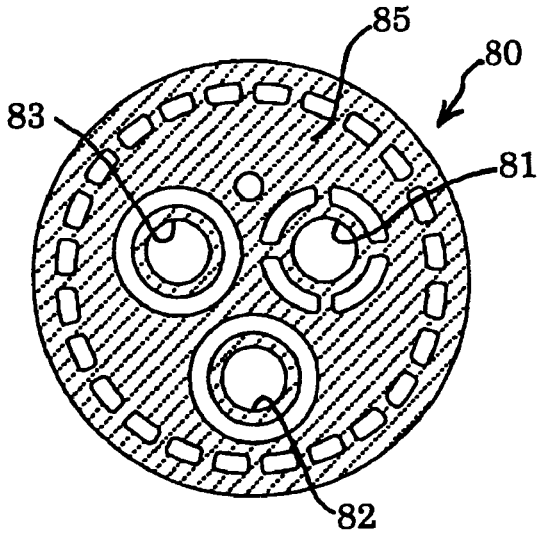

The printed circuit board 80 is circular, carries a front printed wiring pattern 84 where ceramics capacitors are mounted (refer to FIG. 3(A)), and a rear printed wiring pattern 85 (refer to FIG. 3(B)). The printed circuit board 80 has three openings 81, 82 and 83 through which the three connecting terminals 42 pass. Specifically, the connecting terminal 42 integral with No. 1 pin (for the grounding) passes through the opening 81, the connecting terminal 42 integral with No. 2 pin (for the signaling) passes through the opening 82, and the connecting terminal 42 integral with No. 3 pin (for the power supply) passes through the opening 83.

The rear wiring pattern 84 on the printed circuit board 80 will be described with reference to FIG. 3(A). Soldering lands

86, 87, 88 and 89 are provided around the openings 81, 82 and 83, and are used to solder the three connecting terminals 42 in order to connect them to the rear printed wiring pattern 84. The rear printed wiring pattern 84 for the connecting terminal 42 integral with No. 1 pin surrounds not only the wiring patterns to which the other connecting terminals 42 are connected, but also the periphery of the printed circuit board 80. In other words, the grounding wiring pattern occupies a greater part of the rear wiring pattern 84. The soldering lands 86 and 87 are electrically integral with the grounding wiring pattern, and the soldering land 88 is positioned near the soldering land 86 and electrically integral with No. 2 pin. Further, the soldering land 89 integral with No. 3 pin is positioned near the soldering land 87.

The front wiring pattern 85 will be described with reference to FIG. 3(B). Three circular wiring patterns are provided around the openings 81, 82 and 83 through which the three connecting terminals 42 pass. The wiring patterns connected to the connecting terminals 42 integral with No. 2 and No. 3 pins are formed in the shape of a ring. The remaining part of the printed circuit board 80 is for the grounding wiring pattern. Therefore, the wiring pattern connected to the grounding pin surrounds not only the wiring patterns connected to the remaining pins but also the whole peripheral area of the printed circuit board 80.

Figure 4:
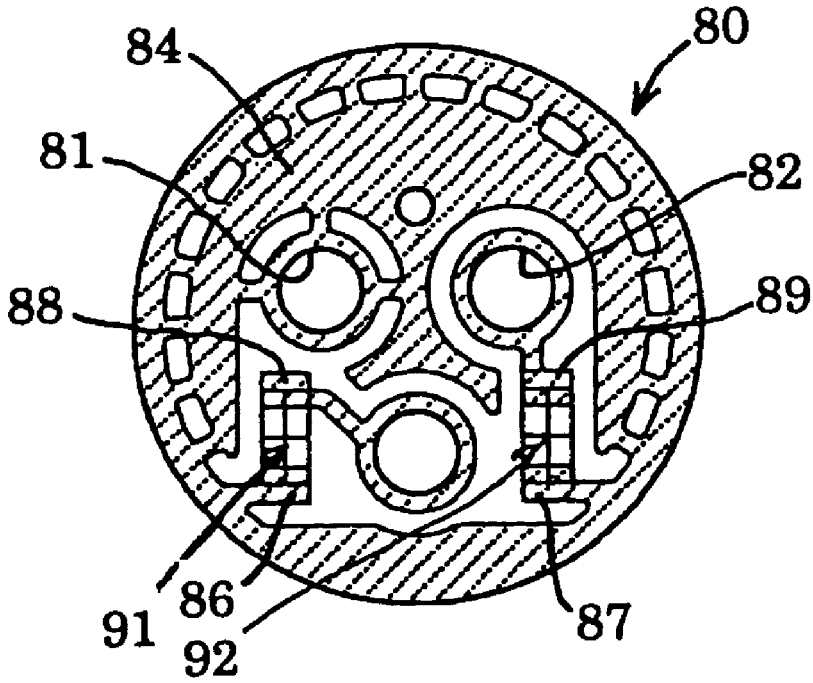
FIG. 4 is a rear elevation of capacitors mounted on the printed circuit board.

Referring to FIG. 4, ceramics capacitors 91 and 92 are mounted in order to short-circuit external high frequency signals. Specifically, the ceramics capacitor 91 is connected across the soldering lands 86 and 88. The three connecting terminals 42 are soldered to the wiring patterns provided around the openings on the opposite surfaces of the printed circuit board 80. The grounding wiring pattern on the printed circuit board 80 is soldered to the cylindrical metal tube 20 and is electrically connected to the cylindrical metal tube 20. Hence, the grounding wire of the receptacle 30 and the microphone cable are electrically connected, and are grounded.

There is a space between an outer surface of the bottom plate 32 fixed to the receptacle 30 and the printed circuit board 80. The ceramics capacitors 91 and 92 are mounted on the printed circuit board 80 in the foregoing space facing with the bottom plate 32.

The foregoing embodiment is advantageous in the following respects. External high frequency signals are short-circuited by the ceramics capacitors 91 and 92 which are connected between the wiring pattern for the grounding and the wiring patterns connected to the other pins. Therefore, the high frequency signals can be blocked before they reach the microphone connector.

Even when the pins of the receptacle 30 are displaced by attaching and detaching the microphone connector, the ceramics capacitors 91 and 92 on the printed circuit board 80 are free from stress, and are prevented from being broken by physical force.

The printed wiring pattern connected to the grounding pin surrounds not only the wiring patterns for the other pins but also the whole area of the printed circuit board, which protects the printed circuit board against high frequency signals.

The printed wiring pattern for the grounding pin is electrically connected to the cylindrical metal tube 20, which totally shields the receptacle 30, and further blocks high frequency signals.

The connector of the invention is applicable not only to the capacitor microphone but also to a variety of fields. When used with the capacitor microphone, the connector is effective in blocking external high frequency signals which cause noise.

What is claimed is:

1. A microphone connector comprising a receptacle which is made of a conductive material, receives a cable connector at one end of a microphone cable, includes a bottom plate, and a plurality of pins passing through the bottom plate, wherein a cylindrical metal tube is coupled to a periphery of the bottom plate and is electrically integral with the receptacle; a printed circuit board is attached to the cylindrical metal tube and covers an opening thereof; connecting terminals are electrically integral with the pins, extend outward from the bottom plate, pass through the printed circuit board, and are electrically connected to wiring patterns on the printed circuit board; and capacitors are connected between the wiring pattern for the grounding pin and the wiring patterns for the other pins, and short-circuit high frequency signals.

2. The microphone connector of claim 1, wherein the capacitors are mounted on a surface of the printed circuit board facing the bottom plate in a space between an outer surface of the bottom plate and the printed circuit board.

3. The microphone connector of claim 1, wherein the wiring pattern for the grounding pin surrounds the wiring patterns for the other pins and a periphery of the printed circuit board.

4. The microphone connector of claim 1, wherein the printed circuit boards are provided with wiring patterns on opposite surfaces thereof, the wiring pattern for the grounding pin surrounds the wiring patterns for the other pins and a periphery of the printed circuit board.

5. The microphone connector of claim 3 or 4, wherein the wiring pattern for the grounding is electrically connected to the cylindrical metal tube.

* * * * *